United States Patent [19]

Chalmers

[11] 3,999,700

[45] Dec. 28, 1976

[54] CREDIT CARD MAILER

[76] Inventor: Hugh John Chalmers, 275 Castro St., San Francisco, Calif. 94114

[22] Filed: June 12, 1975

[21] Appl. No.: 586,503

[52] U.S. Cl. ..... 229/68 R; 229/71

[51] Int. Cl.[2] ..... B65D 27/02; B65D 27/04

[58] Field of Search ..... 229/68 R, 69, 70, 71, 229/72, 87.2, 87.5, 923, 929

[56] References Cited

UNITED STATES PATENTS

| | | | |
|---|---|---|---|
| 1,214,867 | 2/1917 | Young | 229/71 |
| 3,104,800 | 9/1963 | Johnson et al. | 229/70 |
| 3,265,289 | 8/1966 | Hiersteiner | 229/80 |
| 3,380,648 | 4/1968 | Lyra | 229/71 |
| 3,508,702 | 4/1970 | Kaiser | 229/71 |
| 3,773,251 | 11/1973 | Hadick | 229/68 R |

*Primary Examiner*—Stephen P. Garbe
*Assistant Examiner*—Bruce H. Bernstein
*Attorney, Agent, or Firm*—John A. Bucher

[57] ABSTRACT

Multiple embodiments of a credit card mailer or mailing assembly including an envelope, a carrying member having an adhesive area thereupon for releasably engaging one or more credit cards in order to effectively immobilize the credit cards within the envelope and a wrapping member for enclosing the carrying member and masking the presence of the credit cards within the envelope.

12 Claims, 11 Drawing Figures

FIG_4
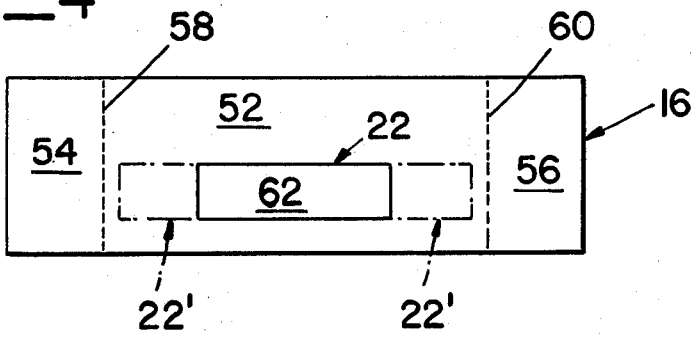
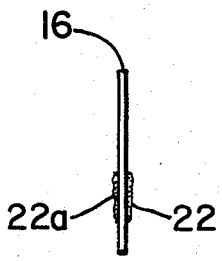
FIG_4a
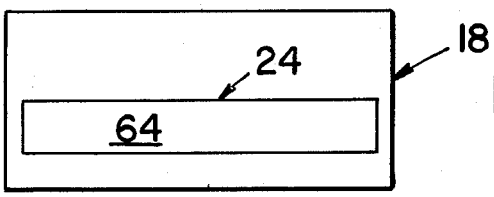
FIG_3
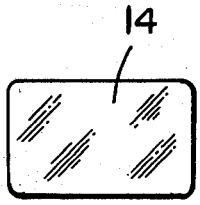
FIG_5
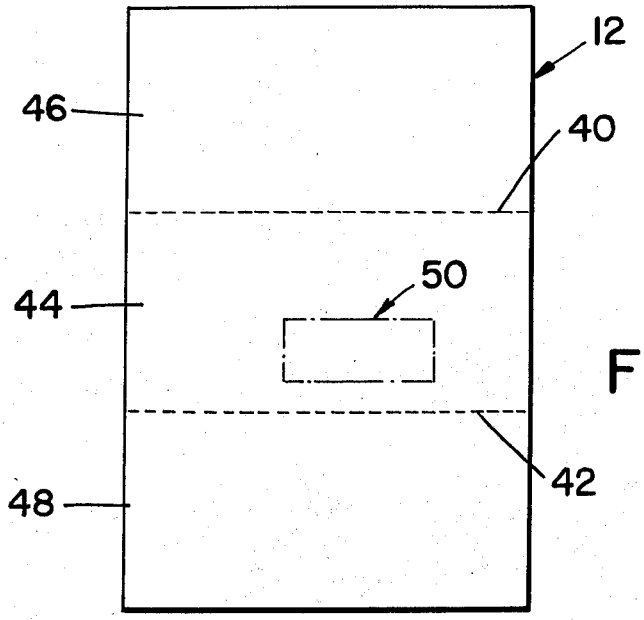
FIG_2
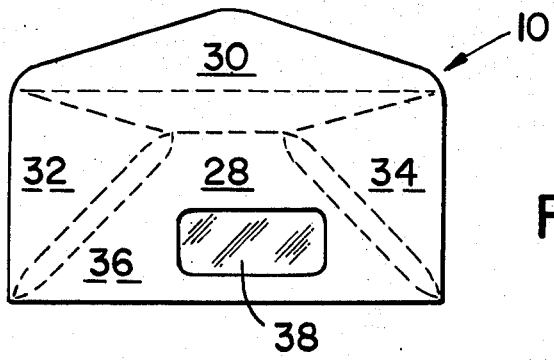
FIG_1

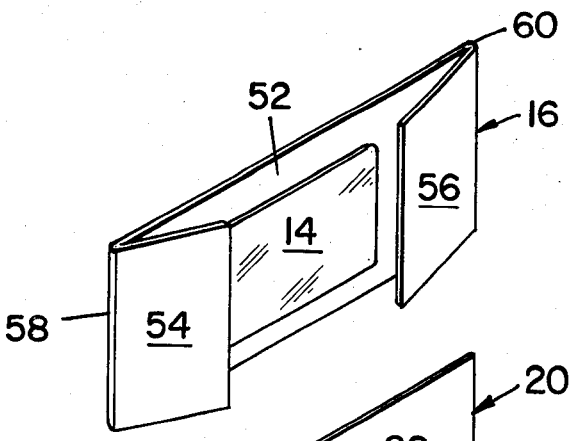
FIG_6
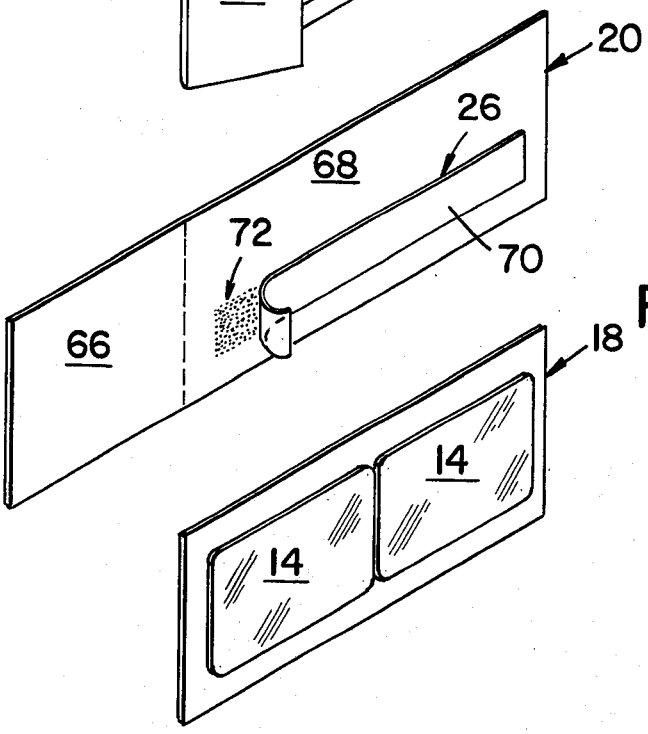
FIG_7
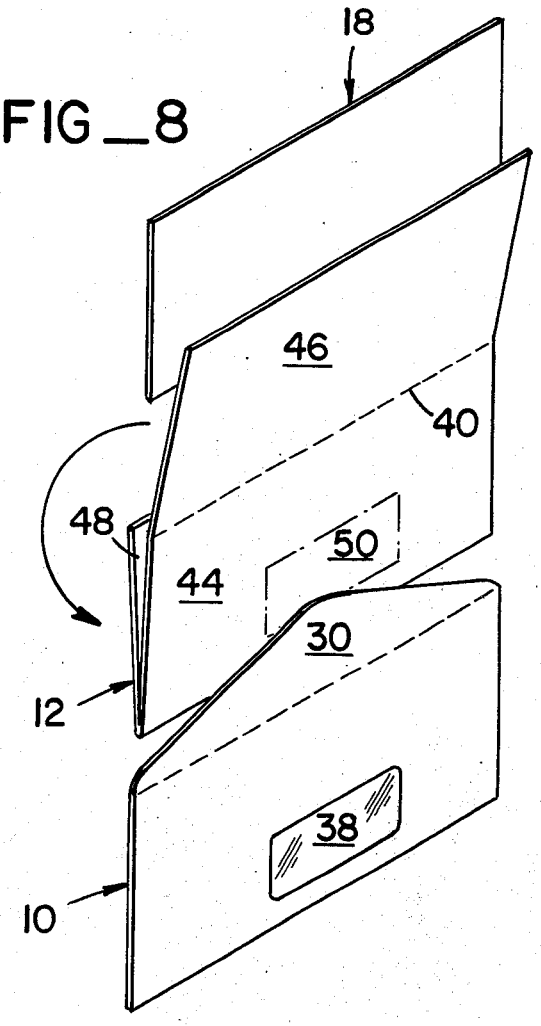
FIG_8
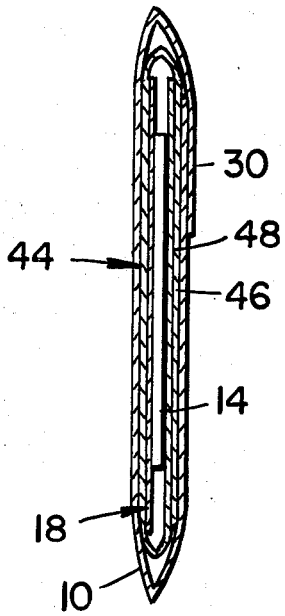
FIG_9
FIG_10

CREDIT CARD MAILER

BACKGROUND OF THE INVENTION

Many business firms, such as banks and retailers in particular, employ credit cards which are delivered to authorized users through the mails. The distribution of such credit cards has become a substantial activity within itself and specialized mailers or mailing assemblies are desirable for a number of purposes. Initially, it is desirable to facilitate the insertion of the credit cards within an addressed envelope in a condition suitable for mailing wherein the credit cards will be protected from damage in the mails.

It has further been discovered that such credit cards may be subject to mail thefts. Accordingly, many business firms have employed heavy mailing assemblies to mask and protect the credit cards while also employing registered mail for their delivery. Such techniques have added to the postage costs while also tending to complicate the assembly of enclosure of the credit cards within the mailing assemblies.

Accordingly, it has been found that a need remains for a mailer assembly wherein one or more credit cards may be readily enclosed and which both protects the credit cards from damage and tends to mask their presence within the envelope in order to better assure delivery of the credit cards to the intended users.

SUMMARY OF THE INVENTION

Accordingly, it is an object of the present invention to provide an improved credit card mailer of simple design for facilitating the handling and mailing of credit cards and the like while protecting the cards from damage during transit in the mails.

An additional object of the invention is to provide such a credit card mailer which is capable of masking the presence of one or more credit cards within the envelope.

Yet another object of the invention is to provide a single mailer adapted to contain either one, two, or more credit cards while accomplishing other objectives as set forth herein.

It is also an important object of the invention to provide such a credit card mailer which is of minimum weight, preferably less than one ounce when entirely assembled together with one or more credit cards in order to minimize postage costs.

These objects are generally accomplished through the use of a credit card mailer including an envelope, a credit card carrying member including an adhesive area for releasably engaging one or more credit cards and a wrapping member for enclosing the carrying member and the credit card or cards mounted thereupon, the size of the carrying member and wrapping member being selected to substantially fill the envelope so that the carrying member tends to effectively immobilize the credit card or cards within the envelope.

Additional objects and advantages of the invention will be apparent from the following description having reference to the accompanying drawings.

BRIEF DESCRIPTION OF THE DRAWINGS

FIG. 1 is a view of an envelope employed within the present credit card mailer.

FIG. 2 is a view of a foldable wrapping member.

FIG. 3 is a view of a carrying member adapted to receive a plurality of, for example, two credit cards.

FIG. 4 is a view of a carrying member adapted to receive a single credit card on one side.

FIG. 4*a* is an edge view of the carrying member of FIG. 4.

FIG. 5 is a view of a credit card of the type contemplated for use within the mailer of the present invention.

FIG. 6 is a view of the carrying member also illustrated in FIG. 4, the carrying member being in a folded condition with a credit card mounted thereupon.

FIG. 7 is a view of yet another carrying member adapted to receive either one or two credit cards upon one side thereof.

FIG. 8 is a view of the carrying member of FIG. 3 with two credit cards being mounted thereupon.

FIG. 9 is an exploded view of a credit card mailer according to the present invention and including the two card carrying member of FIGS. 3 and 8.

FIG. 10 is a section view of an assembled credit card mailer constructed in accordance with the present invention.

DESCRIPTION OF THE PREFERRED EMBODIMENTS

The credit card mailer of the present invention basically comprises an envelope such as that indicated at 10 in FIGS. 1 and 9, a foldable wrapping member indicated at 12 in FIGS. 2 and 9 and various embodiments of a carrying member, each adapted to releasably engage one or more credt cards of the type indicated at 14 in FIG. 5.

A carrying member adapted to receive a single credit card upon one side is indicated at 16 in FIG. 4. Another version of the carrying member adapted to receive two credit cards in end to end relation is indicated at 18 in FIG. 3. Still another version of the carrying member which is adapted to receive either one or a plurality of credit cards is indicated at 20 in FIG. 7. As will be made apparent from the following description, the carrying members 16 and 18 may also be adapted to receive a variable number of credit cards in releasable engagement therewith.

Each of the carrying members, as indicated respectively at 16, 18 and 20, essentially includes an adhesive area which adapts each of the carrying members for releasably engaging one or more credit cards. The adhesive area for the carrying member 16 is indicated at 22 while the respective adhesive areas for the carrying members 18 and 20 are indicated at 24 and 26. The various carrying members are described in greater detail below.

As may be best seen in FIG. 1, the envelope 10 is of a conventional type, including a front panel 28, a sealing flap 30 and rear flaps 32, 34 and 36 which are folded and glued to form a pocket in conjunction with the front panel 28. A transparent address window 38 is provided in the front panel 28. The envelope may be fabricated from any commercially available opaque envelope stock. In addition, a design may be conventionally printed upon the inside of the envelope to prevent its contents from being read through the envelope.

The foldable wrapping member 12 is made up of a rectangular sheet of paper stock having at least a single fold line 40 for dividing the wrapping member into at least two rectangular panels. Preferably, the wrapping member 12 is also formed with a second fold line 42, the two fold lines 40 and 42 dividing the wrapping member into three rectangular panels 44, 46 and 48.

As illustrated in FIG. 2, the three panels are of generally equivalent size. However, within the scope of the present invention, the size of the two end panels 46 and 48 may vary substantially. Assuming that the fold lines 40 and 42 run along the length of the panels, it would be possible to significantly reduce the width of the two outer panels 46 and 48. The central panel 44 must be sized in accordance with the envelope 10 and the particular carrying member, as will be made apparent in greater detail below. In addition, the central panel 44 must be at least somewhat larger than the outer panels in order to allow the outer panels to be folded in overlapping relation without interference. Preferably, the central panel 44 has dimensions only slightly less than the dimensions of the envelope 10 in order to permit the wrapping member with one of the card carrying members being enclosed therein to be inserted into the envelope.

An address area 50 is also provided upon the wrapping member, preferably upon the central panel 44. The address area 50 is arranged upon the central panel so that when the wrapping member is folded and inserted into the envelope, the address area 50 registers with the window 38.

The wrapping member 12 also provides a preferred medium for delivering additional information to the authorized or intended user of the credit card or cards enclosed within the mailer. For example, additional information such as the terms and conditions governing the use of the credit card, legal disclosures as required by law and instructions pertaining to card use may be printed upon any of the panels 44, 46 and 48 except for the address area 50. Further, the panels may be removably attached to each other, for example, by perforation lines, the various panels forming postcards and/or business reply cards suitable, for example, in connection with notification of changes of address, lost or stolen cards and other communications between the user and the business firm issuing the card.

Preferably the panels 44, 46 and 48 of the wrapping member 12 are selectively detachable from each other with the fold lines 40 and 42 being formed by lines of perforation. The function of the wrapping member 12 to enclose one of the carrying members and mask the presence of one or more credit cards mounted thereupon is discussed in greater detail below. The wrapping member 12 may be suitably formed from paper stock such as 32 No. Ledge paper or 80 No., Text paper or other equivalent paper stocks.

Turning now to the carrying members indicated at 16, 18 and 20, they each have a width slightly less than the width of the central panel 44 in the wrapping member 12. This allows the outer panels 46 and 48 to be folded over the carrying member. Each of the carrying members also has either an overall length or a central panel with a length generally equivalent to the length of the panels in the wrapping member 12. Further details for each of the carrying members are set forth immediately below.

Referring initially to the one card carrying member indicated at 16 in FIG. 4, it may be seen that the adhesive area 22 is centrally located upon a central panel 52. Foldable flaps 54 and 56 are arranged at end of the central panel 52 and are secured thereto by means of fold lines 58 and 60.

Preferably, the length of the adhesive area 22 is selected to approximate the length of a single credit card with the length of the end flaps 54 and 56 each approximating one half the length of a credit card. The length of the central panel 52 is approximately equal to the combined length of a plurality of preferably two credit cards. In this manner, the end flaps 54 and 56 may be folded into overlapping relation with the central panel 52 to provide more uniform thickness across the dimension of the central panel 52 when a credit card is releasably attached to the adhesive area 22.

The adhesive area 22 comprises adhesive material permanently bonded to the central panel 52 with a releasable tape 62 initially covering the adhesive. The tape 62 is removable to expose the adhesive for receiving and releasably engaging a credit card such as that indicated at 14 in FIG. 5.

The carrying member 16 may be readily adapted to also receive a plurality of, for example, two credit cards upon the exposed surface thereof. For that purpose, the adhesive area 22 may be extended substantially along the entire length of the central panel 52 as indicated in broken lines at 22'. In this manner, two credit cards may be arranged in end-to-end, generally abutting relation upon the central panel 52. In that event, it is desirable to remove the end flaps 54 amd 56. Accordingly, the fold lines 58 and 60 are preferably formed as lines of perforations to permit selective removal of the flaps. With this arrangement, a single credit card may also be mounted upon the central portion of the adhesive area with the flaps 54 and 56 overlapping and engaging those portions of the adhesive area indicated by broken lines.

The carrying member 16 may be even further modified or illustrated in FIG. 4*a* by also providing a similar adhesive area 22*a* upon its reverse side. In this manner, the single carrying member 16 may be adapted to carry either a single credit card upon either side or a pair of credit cards mounted upon either side.

The carrying member 16 may also have different dimensions for receiving either a different number of credit cards and/or for receiving a different arrangement of credit cards. For example, the width of the central panel 52 may be selected to approximate the length of a single credit card. The length of the central panel 52 could then be selected to approximate a multiple based upon the width for a typical credit card. It would of course be necessary to appropriately size the wrapping member 12 and the envelope 10 in accordance with the size of the central panel 52 for the carrying member. In this manner, the carrying member could be adapted to receive one or more credit cards in generally abutting and side-by-side relation. It will be apparent from the following description that the other carrying members 18 and 20 could also be modified in a generally similar manner.

Referring now to FIG. 3, the carrying member 18 is formed as a single sheet generally approximating the dimensions of the central panel 52 for the carrying member 16 in FIG. 4. Here again, the adhesive area 24 is initially covered by a tape 64 and extends substantially the full length of the carrying member 18. The carrying member 18 is preferably adapted for use only when two credit cards of the type indicated in FIG. 5 are to be sent in the same mailer. FIG. 8 illustrates the carrier member 18 with the tape 64 removed and two credit cards releasably mounted thereupon.

FIG. 6 similarly illustrates the carrying member 16 with the tape 62 removed, a credit card mounted thereupon and the flaps 54 and 56 folded into overlapping relation in the manner described above.

FIG. 7 illustrates the other carrying member 20 which may be considered as a modification of the carrying member 16. The carrying member 16 and 20 are particularly similar in that they are adapted to releasably engage either one or a plurality of credit cards. Rather than the two end flaps 54 and 56 which are provided for the carrying member 16, the carrying member 20 is provided with a single end flap 66 which has a length approximating the length of a single credit card. The adhesive area 26 extends substantially along the entire length of a main panel 68 for the carrier member 20 while being initially covered with a tape indicated at 70. One end of the tape 70 is illustrated as being peeled back in order to expose adhesive material generally indicated at 72 which is permanently bonded or secured to the main panel 68.

The length of the main panel 68 generally approximates the length of two credit cards arranged in end-to-end relation. In this manner, with the tape 70 being removed, a pair of credit cards may be mounted thereupon in generally the same manner as illustrated in FIG. 8. Alternatively, the end flap 66 may be folded into overlapping relation with a portion of the main panel 68 and a portion of the adhesive 72 with a single credit card being mounted upon the exposed portion of the adhesive area 26.

As was indicated above, any one of the carrying members 16, 18 and 20 may be employed in conjunction with the wrapping member 12 to form a mailer together with the envelope 10. The overall assembly of the mailer may be best seen in FIGS. 9 and 10. The mailer of FIG. 9 is illustrated to include the carrier member 18 with two credit cards mounted thereupon. As viewed in FIG. 9, the credit cards are mounted upon the reverse or unexposed side of the carrier. Either of the other carriers 16 or 20 could similarly be employed within the mailer assembly of FIG. 9.

In completing assembly of the mailer, the carrier member 18 with the credit cards mounted thereupon is arranged adjacent the central panel 44 of the wrapping member 12. The outer panels 46 and 48 are then folded over the carrier member and the entire assembly inserted within the envelope 10. As may be also seen within FIGS. 9 and 10, the two outer panels 46 and 48 for the wrapping member 12 preferably overlap or overlie the credit cards mounted upon the carrier member 18. Thus, the two thicknesses of these panels serve to even further mask the presence of the credit cards within the envelope. In addition, as was indicated above, the address area 50 registers with the window 38 when the wrapping member is inserted into the envelope 10. The end panels 46 and 48 for the wrapping member 12 overlap the credit cards and form a tapered assembly as may be best seen from the section view of FIG. 10 in order to better mask the presence of the credit cards within the envelope.

Accordingly, the present invention provides a relatively simple mailer assembly which facilitates the insertion of one or more credit cards therein while protecting the credit cards within the mailer assembly and masking their presence therein. It will be apparent that numerous modifications are clearly possible within the scope of the present invention, a number of these modifications being discussed in detail above. However, it will be apparent from the foregoing that an improved credit card mailer is provided, the extent of which is defined by the following appended claims.

What is claimed is:

1. A credit card mailer for containing at least one credit card, comprising in assembly a rectangular envelope having a length and width, a credit card carrying member of rectangular configuration having a length generally equal to the length of the envelope and a width smaller than the width of the envelope, the carrying member having an area of adhesive for releasably securing a plurality of credit cards and preventing movement of each card within the envelope, the adhesive area being formed as a band extending substantially along the length of the carrying member, the length of the carrying member being sufficient to receive a plurality of credit cards in releasable engagement with the adhesive band, flap means secured to at least one end of the carrying member being foldable into overlapping engagement with the carrying member and the adhesive band, the length of the flap means being equivalent to a dimension of at least one credit card so that the exposed area of the carrying member and adhesive band is also equivalent to a dimension of at least one credit card, and a foldable wrapping member also having a rectangular configuration, the wrapping member being formed with one fold line to divide it into two rectangular panels of substantially equal size, each panel of the wrapping member having a length generally equal to the length of the carrying member and a width also approximately equal to the width of the carrying member, the carrying member being adapted to receive one or more credit cards in releasable engagement upon its adhesive area and enclosable by the wrapping member, the combination of the carrying member including the wrapping member and at least one credit card being insertable within the envelope wherein the adhesive upon the carrying member effectively immobilizes each credit card therein against movement within the envelope, the carrying member and wrapping member in combination tending to mask the presence of each credit card within the mailer assembly.

2. The credit card mailer of claim 1 wherein the foldable wrapping member includes two fold lines forming three rectangular panels of substantially equal size for enclosing the carrying member therebetween.

3. The credit card mailer of claim 1 wherein the envelope, carrying member and wrapping member are formed from materials selected to achieve a minimum mailing weight for the entire mailer assembly while providing both protection and masking for the credit card contained therein.

4. The credit card mailer of claim 1 wherein the length of the carrying member is approximately equal to the combined dimension of two credit cards arranged in releasable engagement with the adhesive band.

5. The credit card mailer of claim 4 wherein the length of the carrying member is selected to receive the credit cards arranged end to end and generally in abutting relation.

6. The credit card mailer of claim 5 wherein the flap means comprises a foldable flap arranged at each end of the carrying member, each of the two flaps having a length approximately equal to one half of the length of a single credit card.

7. The credit card mailer of claim 6 wherein the fold lines between the two flaps and the carrying member are formed by lines of perforations adapted to permit selective removal of the flaps from the carrying member.

8. The credit card mailer of claim 5 wherein the flap means comprises a single foldable flap arranged at one end of the carrying member, the one flap having a length approximately equal to the length of a single credit card.

9. The credit card mailer of claim 8 wherein the fold line is formed between the carrying member and the one foldable flap by a line of perforations adapted to permit selective removal of the flap from the carrying member.

10. The credit card mailer of claim 1 wherein the carrying member initially includes removable tape adhered to the adhesive area, the tape being selectively removable to permit mounting of one or more credit cards upon the carrying member.

11. The credit card mailer of claim 1 wherein the envelope further comprises a transparent address window, the foldable wrapping member including an address area arranged thereupon for register with the address window in the envelope when the wrapping member is disposed within the envelope.

12. A credit card mailer for containing at least one credit card, comprising in assembly a rectangular envelope having a length and width, a credit card carrying member of rectangular configuration having a length generally equal to the length of the envelope and a width smaller than the width of the envelope, the carrying member having areas of adhesive upon opposite surfaces thereof for respectively receiving one or more credit cards in releasable engagement therewith and preventing movement of each credit card within the envelope, and a foldable wrapping member also having a rectangular configuration, the wrapping member being formed with one fold line to divide it into two rectangular panels of substantially equal size, each panel of the wrapping member having a length generally equal to the length of the carrying member and a width also approximately equal to the width of the carrying member, the carrying member being adapted to receive the credit card in releasable engagement upon its adhesive area and enclosable by the wrapping member, the combination of the carrying member including the credit card and the wrapping member being insertable within the envelope wherein the adhesive upon the carrying member effectively immobilizes the credit card against movement within the envelope, the carrying member and wrapping member in combination tending to mask the presence of the credit card within the mailer assembly.

* * * * *